US008210587B2

(12) United States Patent
Mizelmoe

(10) Patent No.: US 8,210,587 B2
(45) Date of Patent: Jul. 3, 2012

(54) GRIPPER FOR OBJECTS

(75) Inventor: Leendert Cornelis Mizelmoe, DA Rotterdam (NL)

(73) Assignee: Peinemann Equipment B.V., Hooglviet (NL)

( * ) Notice: Subject to any disclaimer, the term of this patent is extended or adjusted under 35 U.S.C. 154(b) by 27 days.

(21) Appl. No.: 12/514,788

(22) PCT Filed: Nov. 2, 2007

(86) PCT No.: PCT/NL2007/050531

§ 371 (c)(1),
(2), (4) Date: Dec. 9, 2009

(87) PCT Pub. No.: WO2008/063055

PCT Pub. Date: May 29, 2008

(65) Prior Publication Data

US 2010/0109361 A1 May 6, 2010

(30) Foreign Application Priority Data

Nov. 23, 2006 (NL) ..... 1032933

(51) Int. Cl.
*B66C 1/42* (2006.01)
*B66C 1/56* (2006.01)
*B66C 1/62* (2006.01)

(52) U.S. Cl. ..... 294/201; 294/192; 294/106; 414/739

(58) Field of Classification Search ..... 294/88, 294/86.41, 106, 902, 192, 198, 201, 202, 294/205, 115, 86.4; 405/154, 156, 154.1; 414/731, 739, 408

See application file for complete search history.

(56) References Cited

U.S. PATENT DOCUMENTS

| | | | | |
|---|---|---|---|---|
| 2,226,789 | A | 12/1940 | Tupy | |
| 3,064,324 | A | 11/1962 | Schaper | |
| 3,902,614 | A * | 9/1975 | Roberts et al. | 294/106 |
| 4,023,848 | A * | 5/1977 | Bennett | 294/198 |
| 4,703,968 | A * | 11/1987 | LaBounty | 294/88 |
| 5,092,731 | A * | 3/1992 | Jones et al. | 294/106 |
| 5,219,265 | A * | 6/1993 | Recker | 414/731 |
| 5,391,039 | A | 2/1995 | Holtom | |
| 5,863,086 | A * | 1/1999 | Christenson | 294/106 |
| 6,244,643 | B1 * | 6/2001 | Tillaart | 294/86.41 |
| 6,280,119 | B1 | 8/2001 | Ryan | |
| 7,052,060 | B2 * | 5/2006 | Vigholm et al. | 294/198 |
| 7,207,610 | B1 * | 4/2007 | Kauppila | 294/88 |
| 2005/0140154 | A1 | 6/2005 | Vigholm et al. | |

FOREIGN PATENT DOCUMENTS

| | | |
|---|---|---|
| FR | 1559727 | 3/1969 |
| GB | 1241818 | 8/1971 |
| NL | 8501455 | 12/1986 |

* cited by examiner

*Primary Examiner* — Paul T Chin
(74) *Attorney, Agent, or Firm* — Bozicevic, Field & Francis LLP; Bret E. Field; Benjamin C. Pelletier

(57) ABSTRACT

The invention relates to a device for engaging objects, such as heat exchangers of varying sizes. The device includes at least one gripper provided with at least a first and a second gripper arm, at least one of which is movable with respect to the other gripper arm for enclosing an object therebetween; and a driving mechanism connected to at least one of the first and second gripper arms for closing or opening the gripper as needed, wherein at least one of the first and second gripper arms includes a first and a second gripper arm part that are pivotally coupled together, and an adjusting mechanism provided between the first and second gripper arm parts, the adjusting mechanism being arranged for adjusting the angle between the gripper arm parts in dependence on the diameter of the object to be engaged prior to engaging the object.

20 Claims, 2 Drawing Sheets

GRIPPER FOR OBJECTS

Figure 1:
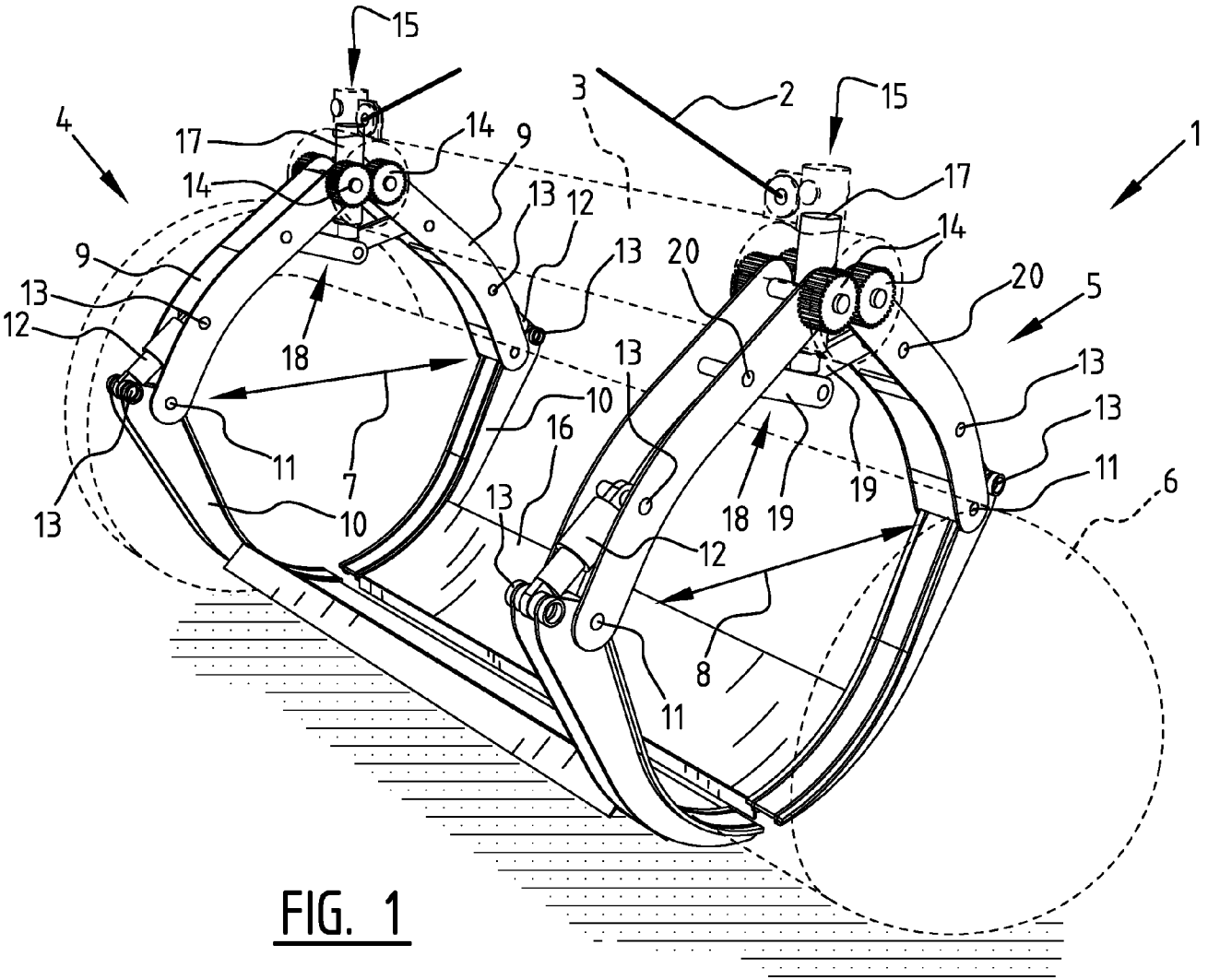

The present invention relates to a device for engaging objects, such as heat exchangers of varying sizes, which comprise a bundle of feed-through tubes extending between two end plates, said device comprising at least one gripper provided with: at least a first and a second gripper arm, at least one of which is movable with respect to the other gripper arm for enclosing at least one object therebetween; and a driving mechanism connected to at least one of said first and second gripper arms for closing or opening the gripper as needed.

Such grippers are generally known, and the gripper arms are made substantially in one piece. Usually, such one-piece gripper arms are bent or curved to as to be able to enclose an elongated object to be manipulated. The circle described by the gripper arms in the closed condition thereof in fact defines a space that is available for engaging an object to be manipulated. Said described circle is directly related to the bend, the curvature or the configuration of the one-piece gripper arms.

Such a configuration according to the prior art has the disadvantage that an object having a smaller outer circumference than the circle described by the gripper arms can roll or slide within the gripper in the closed condition of the gripper arms. When the gripper arms are configured to exhibit a certain curvature, objects having a larger outer circumference than the circle being described by the gripper arms can only be engaged with difficulty, in which case the gripper arms will not be able to enclose the object to be manipulated completely, however.

The object of the present invention is to provide a more versatilely usable gripper, by means of which smaller objects can be tightly and securely engaged, whilst it is furthermore possible to adapt the gripper to the outside contour of larger objects to be manipulated. In order to accomplish that object, a device according to the present invention is characterised in that at least one of said first and second gripper arms comprises a first gripper arm part and the second gripper on part, which first and second gripper arm parts are pivotally coupled together, and an adjusting mechanism provided between said first and second gripper arm parts, said adjusting mechanism being arranged for adjusting the angle between said gripper arm parts in dependence on the diameter of the object to be engaged prior to engaging said object. In this way the resulting curvature or configuration of each gripper arm, or at least of one of the two gripper arms, can be adjusted as needed. Thus, smaller objects to be manipulated can be securely clamped down and enclosed, and the same holds for larger objects that the gripper needs to be capable of manipulating.

It is noted at this stage already that many other configurations of the curvature or the bent form of gripper arms that jointly form a gripper are possible as well. Usually said gripper arms will consist of gripper arm segments, however, for example more than two gripper arm segments, which are adjustable relative to each other but which must nevertheless still be sufficiently alike in that case to jointly form a gripper arm.

Various preferred embodiments of a device according to the present invention are possible, which embodiments are defined in the dependent claims. Thus, the device may comprise at least two grippers. In particular in the case of comparatively elongated object it may be advantageous to provide a gripper at several positions along the length thereof so as to be able to engage a comparatively elongated object in a more stable manner. In another embodiment it is possible within this framework for the device to comprise at least one connecting element between said at least two grippers. Thus it is also possible to realise a coordinated action of the two grippers along, via or in the connecting element. A coordinated action of the two or more than two grippers is understood to mean not only a synchronised action, in which both grippers are simultaneously closed or opened. It may also be an action in which the grippers are individually closed or opened.

According to an additional or alternative embodiment, a support may be provided between two corresponding gripper arms in a configuration comprising at least two grippers for supporting the object thereon. By connecting the gripper arms of the individual grippers in this way by means of a support, an object to be manipulated can be supported over a larger distance, thus providing a larger contact area for manipulating the object to be manipulated without any risk of damage.

In another alternative or additional embodiment, the device may be characterised in that at least one of said driving mechanism and said adjusting mechanism can be selectively actuated by means of a hydraulic power source. This embodiment is in particular advantageous if a crane or other apparatus of which the device according to the present invention may form part or to which the device can be selectively connected comprises a hydraulic power source.

This is the case with a great many cranes, and for that reason such an embodiment may be advantageous. Nevertheless, it is also possible to use other power sources, such as an electric power source for electric motors, etc.

On the other hand it may be very advantageous if a hydraulic power source is used to configure the adjusting mechanism as a cylinder extending between and acting on the gripper arm parts. In this way it is possible to adjust the angular position of the gripper arm parts relative to each other and thus also the curvature or bent form of the gripper arms as a whole. Furthermore, the driving mechanism for the gripper arms themselves may be formed by a cylinder or at least comprise a cylinder.

In another alternative or additional embodiment, the driving mechanism may comprise a linkage which is pivotally coupled to the first and second gripper arms. Said linkage can define a parallelogram configuration in combination with the gripper arms. A driving element may act on selected pivot points in the parallelogram configuration in that case. Such a driving element may be a cylinder. In this way the gripper arms of the device can be driven in an elegant manner.

Additionally and/or alternatively it is furthermore possible to provide an embodiment of the device according to the present invention wherein the two gripper arms of at least one gripper are movable, and wherein the first and second gripper arms are coupled by means of meshing gears on said first and second gripper arms for synchronous movement in opposite directions thereof. Although it has been noted in the foregoing that the grippers may also be individually actuated, and although it will be understood that the same holds for gripper arms of grippers, synchronous movement in opposite directions of gripper arms of at least one gripper may provide an advantageous embodiment. Especially if this is realised by means of a simple configuration comprising counter rotating gears, it can be ensured that the gripper arms are securely closed round an object to be manipulated.

Figure 2B:
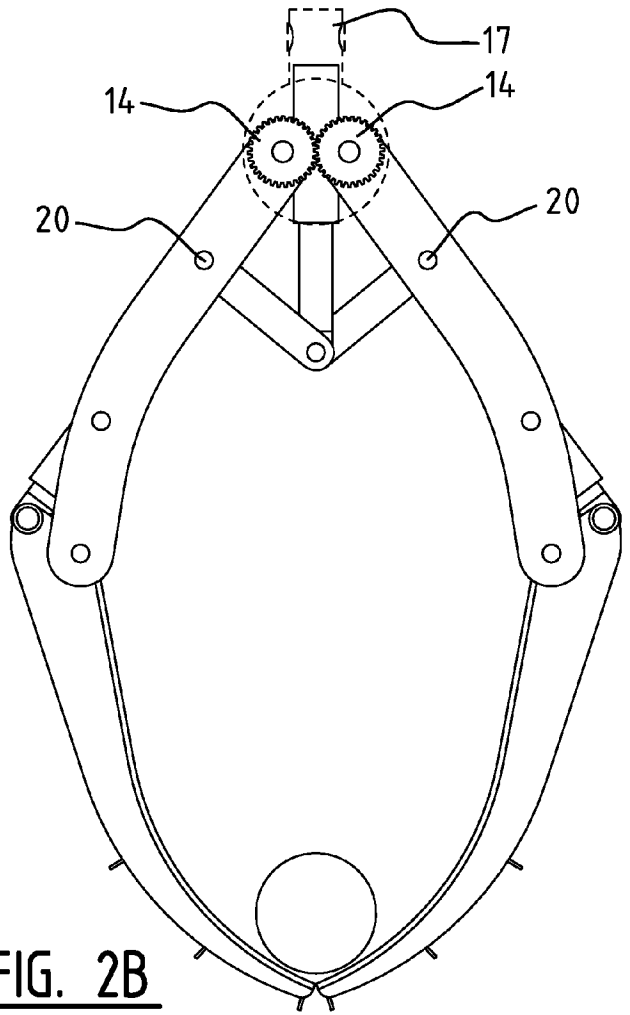
Figure 2A:
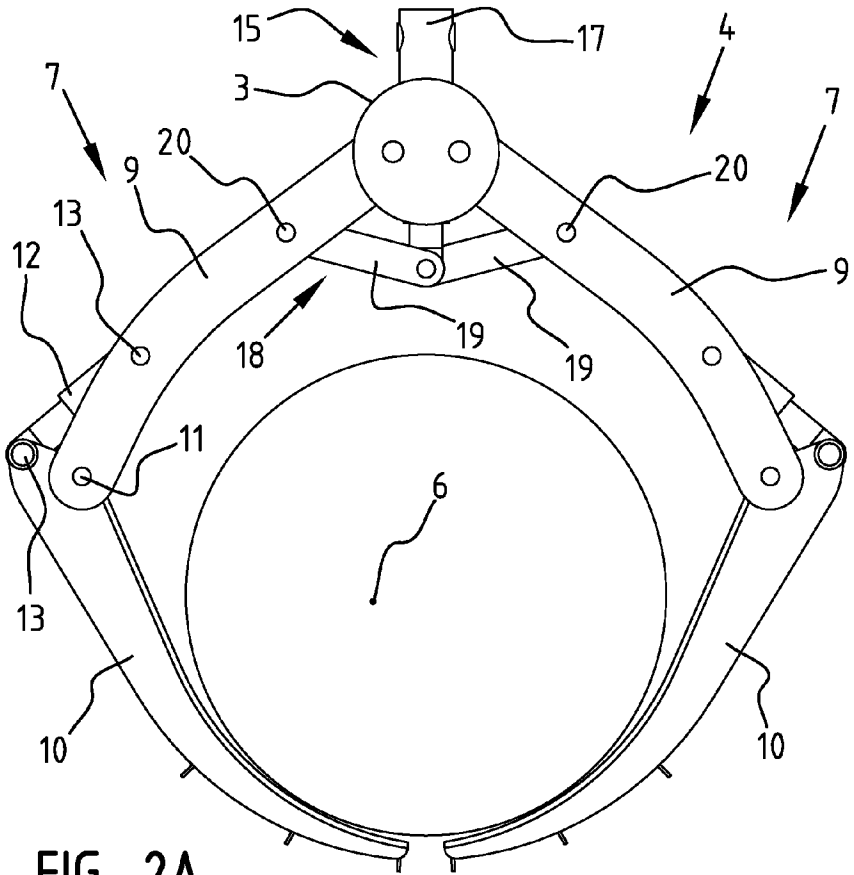

Hereinafter an embodiment of the present invention will be described in more detail. It is noted that the description merely describes an example of a possible embodiment and that the invention is not limited to such an embodiment. Furthermore, individual elements are indicated by the same numerals, insofar as applicable, in the various drawings and views. In the drawing:

FIG. 1 shows a perspective view of a device according to the present invention in use; and FIGS. 2A and 2B show a single gripper as shown in FIG. 2 during various operative conditions thereof.

FIG. 1 shows a device 1 as a possible embodiment of the present invention. The device 1 comprises a suspension 2, to which a carrier beam 3 is attached. Two grippers 4, 5 are mounted to the ends of the carrier beam 3.

The grippers 4, 5 can be used for engaging, picking up, moving and generally manipulating an elongated object 6. The cylindrical object 6 may be an industrial heat exchanger. In said heat exchanger, fluid conducting tubes extend between end plates (not shown). The dotted lines only show the outside contour of the assembly or the bundle of said fluid-conducting tubes. Such cylindrical objects 6 may have varying outside contours, in particular varying diameters. The grippers 4, 5 are designed to optimally engage and manipulate cylindrical objects 6 of varying diameters.

To that end the grippers 4, 5 each comprise two gripper arms 7, 8, respectively.

For the sake of clarity of the description, the gripper arms 7 will now be described in more detail, in which connection it is noted that the gripper arms 8 have substantially the same configuration. This only applies to the embodiment that is shown in FIG. 1, however.

The gripper 4 comprises two gripper arms 7, which are suspended from the carrier beam 3 in such a manner as to be movable in opposite directions towards and away from each other. Each of the gripper arms 7 comprises two gripper arm parts 9, 10. The gripper arm parts 9, 10 are pivotally coupled together at a point of attachment 11.

A cylinder 12 extends past the connecting point 11 between two mounting points 13. When the cylinder 12 is actuated to extend, the angle between the gripper arm parts 9, 10 becomes more acute. Thus, the gripper arms 7 of the gripper 4 can be adapted to the external diameter of the object 6 to be manipulated. Said adaptation is shown in more detail in FIGS. 2A and 2B. The intention of this is that the gripper arms 7 can engage round the object 6 to be manipulated without excessive play. FIG. 2A shows an object 6 to be manipulated that has a relatively large external diameter. In such a case the gripper arms 7 will have to include a more acute angle with each other in order to make a wider space available between said arms for accommodating the object 6 to be manipulated. The gripper that is shown in FIG. 2B, which is configured identically to the embodiment that is shown in FIG. 2A, can be adjusted by means of the cylinders 12 to accommodate a much smaller external diameter of the object 6 to be manipulated. To that end the cylinders 12 are actuated to bridge a shorter distance between the mounting points 13. The angle between the gripper arm parts 9, 10 is thus made less acute or larger, as is clearly shown in FIG. 2B.

Referring back now to FIG. 1, the gripper arms 7 of the gripper 4, as well as the gripper arms 8 of the gripper 5, are shown to be interconnected by means of gears 14. In this way it can be ensured that the gripper arms 7, 8 of the grippers 4, 5 will move synchronously in opposite directions upon actuation of a driving mechanism 15 (schematically shown). Each of the grippers 4, 5 has its own driving mechanism 15. Said driving mechanisms can be driven, actuated or controlled to open and/or close the grippers 4, 5 simultaneously and synchronously. On the other hand it may also be possible to effect the closing of the gripper 4 and/or the gripper 5 separately by means of the driving mechanisms 15. In the embodiment that is shown in FIG. 1, however, the grippers 4, 5 move synchronously. This has been effected by synchronising the driving mechanisms 15, and further by means of supports 16. The supports 16 extend between the corresponding gripper arm parts 10 of the grippers 4 and 5. In this way it is ensured that the synchronous movement of the driving mechanisms 15 is effected not only by synchronising the two driving mechanisms but also by using mechanical forcing means.

It is furthermore noted that the driving mechanisms 15, too, comprise a hydraulic cylinder 17. The cylinders 17 extend from the carrier beam 3 to a pivot point in a linkage 18. The linkage 18 comprises pivotally coupled-together arms 19, which are pivot-mounted to the gripper arms 7, 8 in mounting points 20. When the cylinder 17 of the driving mechanism 15 is actuated to extend in the configuration that is shown in FIG. 1, the gripper arms 7, 8 of the grippers 4, 5 will be moved closer together. When on the other hand the cylinders 17 are driven or controlled to retract the piston rods thereof, the gripper arms 7, 8 of the grippers 4, 5 will be moved apart. Thus the arms 19, together with parts of the first gripper arm parts 9, form a parallelogram configuration, which forms part of the driving mechanism 15 together with the cylinder 17.

Several alternative and additional embodiments and possibilities will be available to a person skilled in the art who has perused the foregoing, which embodiments all fall within the scope of the appended claims, unless said additional and/or alternative embodiments and possibilities depart from the letter and the spirit of said claims. Thus it is possible for the individual grippers 4 and 5 to be driven separately without synchronisation, in which case the supports 16 must be left out, however. The gripper arms 7, 8 may also be driven separately other than synchronously in opposite directions, as is effected by means of the gears 14 in the embodiments illustrated and discussed herein. Each of the gripper arms 7, 8 may be separately driven. It is also possible to use power sources other than a hydraulic power source for driving the gripper arms 7, 8 and/or adjusting the angular position of said gripper arms 7, 8. It is noted, however, that the adjusting possibilities provided by the individual gripper arm parts 9, 10 make it possible to realise an individual adjustment for each individual gripper arm 7, 8, and thus an adaptation to the outside contour of an object 6 to be manipulated. It is preferred to use hydraulic drive means, since a crane or similar apparatus for manipulating objects to be manipulated will generally be provided with such a hydraulic power source.

The invention claimed is:

1. A device for engaging objects which comprise a bundle of feed-through tubes extending between two end plates, said device comprising at least one gripper provided with:

at least a first and a second gripper arm, at least one of which is movable with respect to the other gripper arm for enclosing at least one object therebetween; and a driving mechanism connected to at least one end of said first and second gripper arms for closing or opening the gripper as needed, wherein at least one of said first and second gripper arms comprises a first gripper arm part having a first end and a second end and a second gripper arm part having a first end and a second end, wherein an end of the first gripper arm part is pivotally connected to an end of the second gripper arm part, and wherein an end of the second gripper arm part forms an end part of the gripper arm, wherein the first and second gripper arm parts are arranged to be adjusted relative to each other by an adjusting mechanism, such that said gripper arms can be adjusted in dependence on the diameter of the object to be engaged prior to engaging said object and such that said object is enclosed, and wherein the driving mechanism comprises a linkage which is pivotally coupled to the first and second gripper arms, which can define a parallelogram configuration in combination with the gripper arms, as well as a driving element, a cylinder, which acts on pivot points in the parallelogram configuration.

2. A device according to claim 1, comprising at least two grippers.

3. A device according to claim 2, further comprising at least one connecting element between said at least two grippers.

4. A device according to claim 2 or 3, wherein a support is provided between two corresponding gripper arms for supporting the object thereon.

5. A device according to claim 1, wherein at least one of said driving mechanism and said adjusting mechanism can be selectively actuated by means of a hydraulic power source.

6. A device according to claim 5, wherein the adjusting mechanism comprises a cylinder extending between and acting on the gripper arm parts.

7. A device according to claim 5, wherein said driving mechanism comprises a cylinder.

8. A device according to claim 1, wherein the first and second gripper arms of the at least one gripper are movable, and wherein the first and second gripper arms are coupled by means of meshing gears on said first and second gripper arms for synchronous movement in opposite directions thereof.

9. A device according to claim 1, wherein said gripper arms are adapted to securely close round the outside contour of an object to be manipulated.

10. A device according to claim 1, wherein the device is configured to be used with a crane.

11. A device according to claim 10, wherein the device is operatively coupled to a crane.

12. A device according to claim 1, wherein an end of the first gripper arm part and an end of the second gripper arm parts are pivotally coupled together, and wherein the device comprises an adjusting mechanism provided between said first and second gripper arm parts, said adjusting mechanism being arranged for adjusting the angle between said gripper arm parts in dependence on the diameter of the object to be engaged prior to engaging said object.

13. A device according to claim 12, comprising at least two grippers.

14. A device according to claim 13, further comprising at least one connecting element between said at least two grippers.

15. A device according to claim 14, wherein a support is provided between two corresponding gripper arms for supporting the object thereon.

16. A device according to claim 12, wherein at least one of said driving mechanism and said adjusting mechanism can be selectively actuated by means of a hydraulic power source.

17. A device according to claim 16, wherein the adjusting mechanism comprises a cylinder extending between and acting on the gripper arm parts.

18. A device according to claim 17, wherein said driving mechanism comprises a cylinder.

19. A device according to claim 16, wherein said driving mechanism comprises a cylinder.

20. A device for engaging objects which comprise a bundle of feed-through tubes extending between two end plates, said device comprising at least one gripper provided with:

at least a first and a second gripper arm, at least one of which is movable with respect to the other gripper arm for enclosing at least one object therebetween; and a driving mechanism connected to at least one end of said first and second gripper arms for closing or opening the gripper as needed, wherein at least one of said first and second gripper arms comprises a first gripper arm part having a first end and a second end and a second gripper arm part having a first end and a second end, wherein an end of the first gripper arm part is pivotally coupled to an end of the second gripper arm part, and wherein an adjusting mechanism is provided between said first and second gripper arm parts, said adjusting mechanism being arranged for adjusting the angle between said gripper arm parts in dependence on the diameter of the object to be engaged prior to engaging said object, and wherein the driving mechanism comprises a linkage which is pivotally coupled to the first and second gripper arms, which can define a parallelogram configuration in combination with the gripper arms, as well as a driving element, a cylinder, which acts on pivot points in the parallelogram configuration.

* * * * *